United States Patent [19]

Ijames

[11] Patent Number: 4,518,117

[45] Date of Patent: May 21, 1985

[54] FURNACE STRUCTURE

[76] Inventor: Gerald A. Ijames, 15090 Manor, Detroit, Mich. 48238

[21] Appl. No.: 486,190

[22] Filed: Apr. 18, 1983

[51] Int. Cl.[3] ..... F24B 7/00

[52] U.S. Cl. ..... 237/53; 126/99 A; 126/110 R

[58] Field of Search ..... 126/61, 63, 66, 90 R, 126/87, 110 R, 99 R, 99 A; 237/50, 51, 55

[56] References Cited

U.S. PATENT DOCUMENTS 610,795 9/1898 Bowers ..... 126/61

1,987,145 1/1935 Hager ..... 126/90 R 4,258,693 3/1981 Baker ..... 126/61

*Primary Examiner*—Henry Bennett

*Attorney, Agent, or Firm*—Dale R. Small & Associates

[57] ABSTRACT

Furnace structure including an outer enclosure divided into a cool air chamber and a hot air chamber separated by a combustion gas chamber through which heat exchange tubes pass air between the cool air chamber and the hot air chamber. The furnace structure further includes a burner in the combustion gas chamber, a blower connected to the cool air chamber and a flue for the combustion gases including a draft diverter therein.

8 Claims, 4 Drawing Figures

FURNACE STRUCTURE

BACKGROUND OF THE INVENTION

1. Field of the Invention

The invention relates to furnaces and refers more specifically to a hot air furnace which is particularly compact and efficient and includes a cool air chamber and a hot air chamber separated by a combustion gas chamber through which heat exchange tubes pass air to be heated between the cool air chamber and the hot air chamber.

2. Description of the Prior Art

In the past, furnace structures have often included tubes through which combustion gases have been passed and around which air to be heated has been forced. Such furnace structures of the past have been larger than necessary and inefficient in their use of fuel. In particular, with such furnace structures of the past, the hot combustion gases have not been sufficiently circulated in contact with members carrying cool air to be heated to remove sufficient heat from the combustion gases prior to the combustion gases being passed out of the furnace structures.

SUMMARY OF THE INVENTION

In accordance with the invention, furnace structures is provided which is particularly compact and efficient. The furnace structure of the invention includes an outer enclosure, a hot air chamber at one end of the outer enclosure, a cool air chamber at the other end of outer enclosure and across the top of the outer enclosure, and a combustion gas chamber between the cool air chamber and hot air chamber and the bottom of the furnace enclosure. A burner is provided in the combustion gas chamber at the bottom thereof adjacent the front portion of the cold air chamber, and a combustion gas flue extends through the hot air chamber from the top of the combustion gas chamber next to the hot air chamber. A plurality of heat exchange tubes extend from the top portion of the cool air chamber vertically downwardly into the combustion gas chamber and then horizontally toward the back end of the outer enclosure into the hot air chamber through which air to be heated is forced between the cool air chamber and hot air chamber by means of a blower connected to the cool air chamber.

Baffles are provided in the combustion gas chamber to increase the circulation of combustion gas about the heat exchange tubes whereby maximum heat transfer from the combustion gas to the air to be heated is effected.

DESCRIPTION OF THE PREFERRED EMBODIMENT

Figure 1:
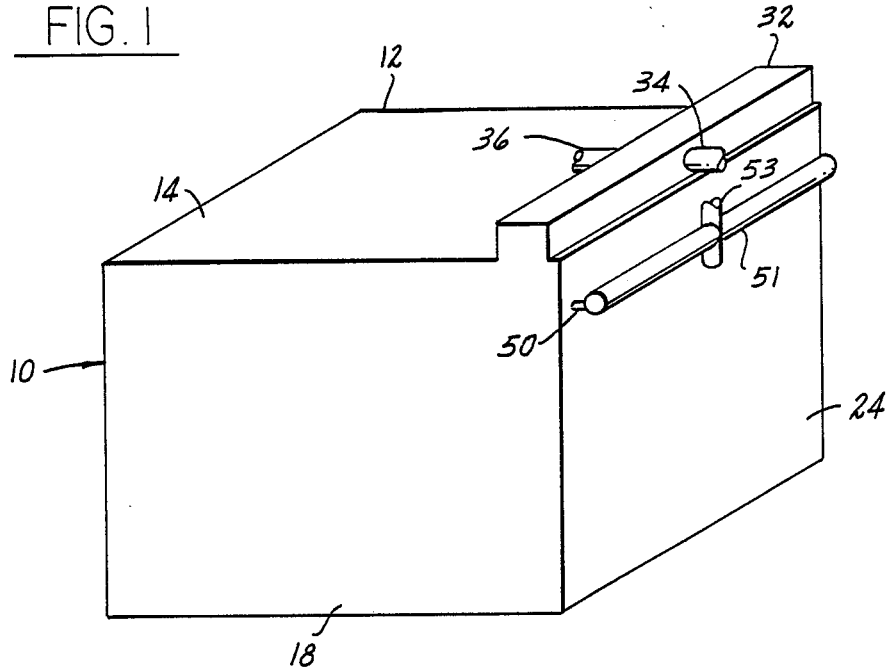
FIG. 1 is a perspective view of furnace structure constructed in accordance with the invention.
Figure 2:
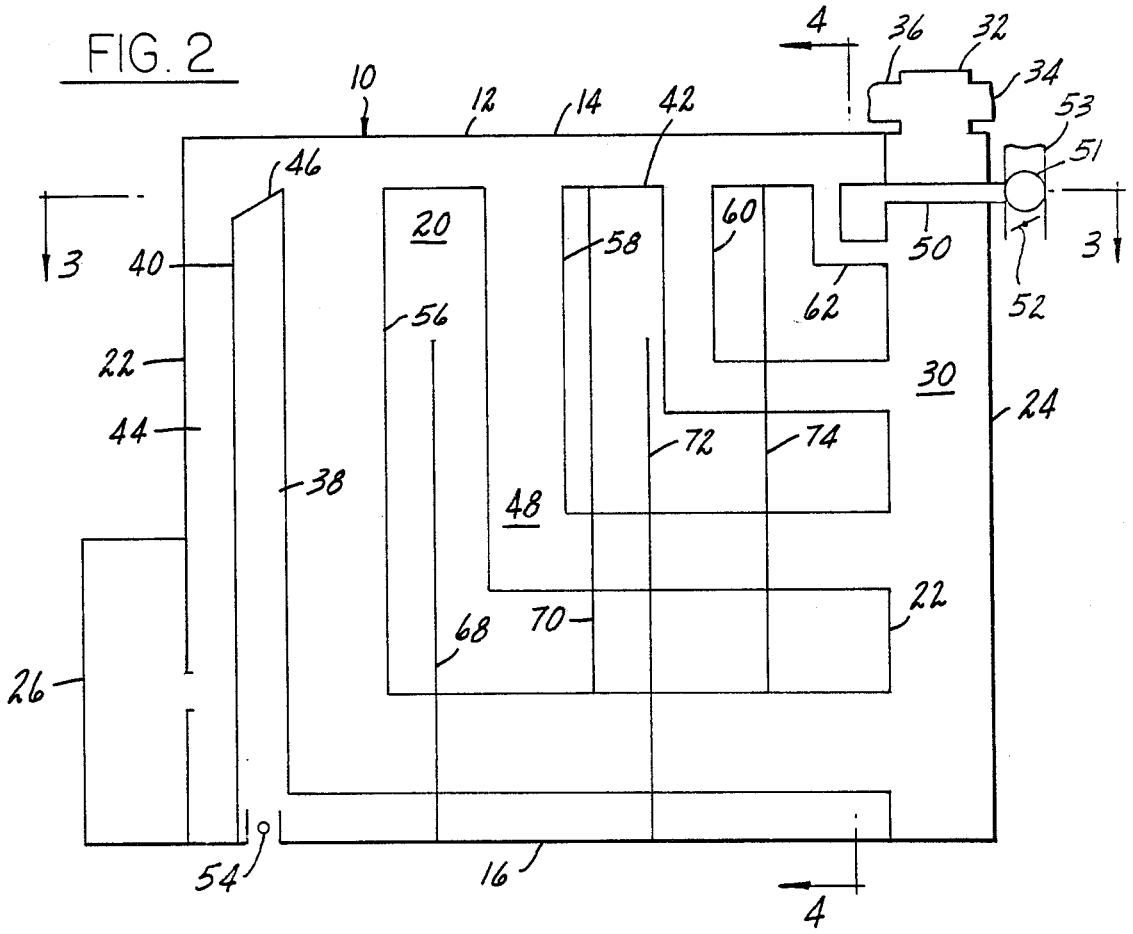
FIG. 2 is a section view of the furnace structure illustrated in FIG. 1 taken substantially on the line 2—2 in FIG. 3.
Figure 3:
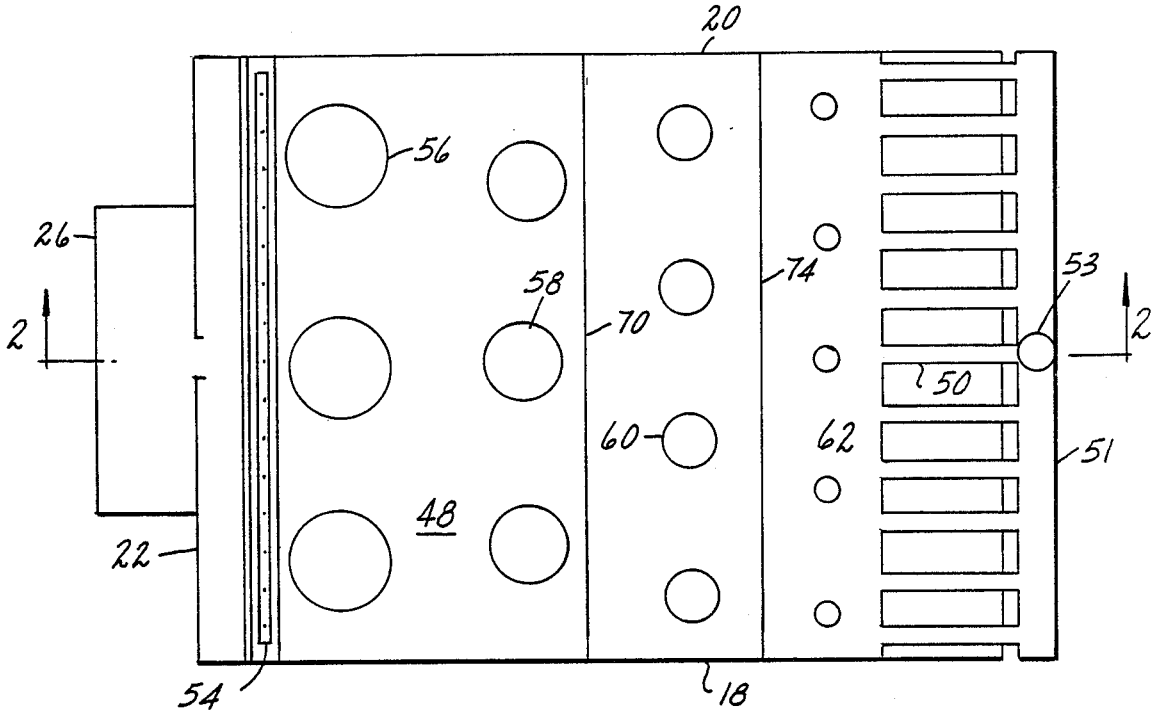
FIG. 3 is a section view of the furnace structure illustrated in FIG. 1 taken substantially on the line 3—3 in FIG. 2.

As shown best in FIG. 2, the furnace structure 10 of the invention includes an outer enclosure 12 having a top 14, a bottom 16, two sides 18 and 20, best shown in FIG. 3 and a front end 22 and back end 24. A blower 26 is attached to the front end of the outer enclosure. The furnace structure 10 has in a preferred embodiment outer dimensions of 18 inches in length, 14 inches in height, and 12 inches in width.

A hot air partition 28 extends parallel to the back end 24 of the outer enclosure 12 providing hot air chamber 30 with the outer enclosure. The hot air chamber 30 discharges hot air therein into a hot air plenum 32 from which hot air from the hot air chamber 30 may be distributed through hot air ducts 34 and 36 which are not part of the present furnace structure.

A cold air partition 38 including a portion 40 extending parallel to the front 22 of the outer enclosure 12 and a portion 42 extending parallel to the top 14 of the outer enclosure 12 defines a cold air chamber 44 which extends completely across the outer enclosure 12 between the sidewalls 18 and 20 thereof. An inclined portion 46 may be provided between the portions 40 and 42 of the partition 38 to facilitate air flow in the cool air chamber 44, if desired.

The volume defined between the cold air partition 38, the hot air partition 22, bottom 16 and sides 18 and 20 of the outer enclosure is a combustion gas chamber 48. The combustion gas chamber 48 has exhaust tubes 50 as shown best in FIGS. 2 and 3, extending out of the outer enclosure 12 of the furnace structure 10 through the hot air chamber 30. In the preferred embodiment thirteen equally spaced three eights inch diameter exhaust tubes 50 extend between the hot air partition 22 and the back end 24 of the outer enclosure 12. The exhaust tubes 50 terminate outside of the outer enclosure in a manifold tube 51. An adjustable draft diverter 52 is provided in an exhaust flue 53.

A burner 54 is also provided in the combustion gas chamber 48 at the bottom thereof adjacent the portion 40 of the cold air partition 38. The burner 54 may be a gas burner of a type which utilizes air and gas for combustion purposes to produce hot combustion gas. Such burners are well known and will not therefore be considered in detail herein.

Figure 4:
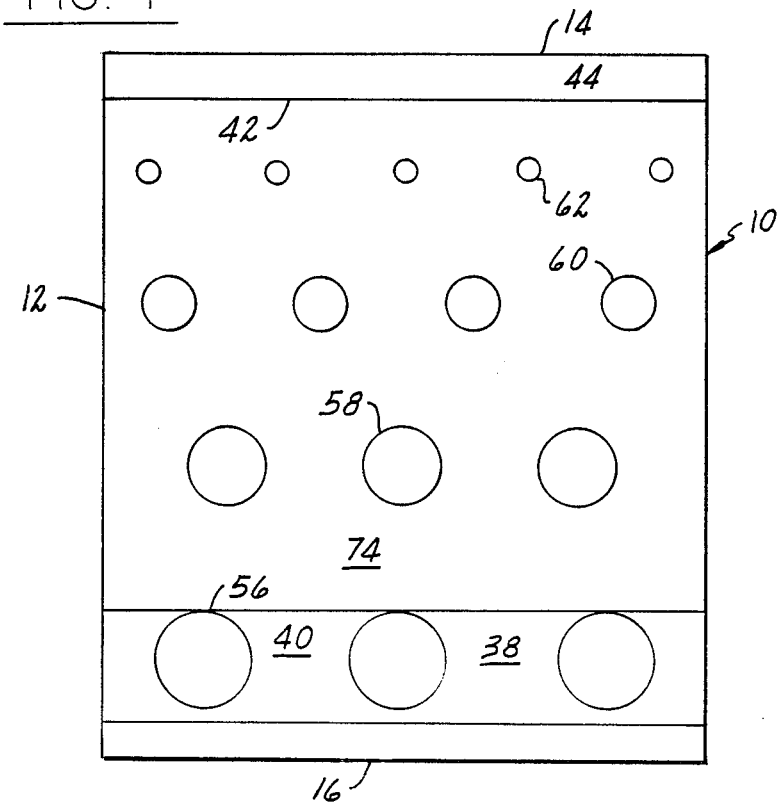
FIG. 4 is a section view of the furnace structure illustrated in FIG. 1 taken substantially on the line 4—4 in FIG. 2.

L-shaped heat exchange tubes are provided in rows 56,58,60 and 62 as shown best in FIGS. 2 through 4. The rows of heat exchange tubes 56,58,60 and 62 conduct air to be heated from the cold air chamber 44 to the hot air chamber 30 through the combustion gas chamber 48 under pressure from the blower 26.

The row of heat exchange tubes 56 in the embodiment of the invention shown includes three separate tubes spaced two inches from each other which are two inches in diameter. The tubes 56 are then spaced one half inch from the walls 18 and 20 of the outer enclosure of the furnace structure 10.

The row 58 of heat exchange tubes includes three inch and half diameter tubes. The heat exchange tubes in the row 58 are spaced apart two inches from each other and are spaced an inch and three quarters from the sidewalls 18 and 20.

The row of heat exchange tubes 60 includes four separate tubes which are again spaced apart two inches from each other and are spaced one inch from the sidewalls 18 and 20. The heat exchange tubes in the row 60 are one inch in diameter.

Five one half inch heat exchange tubes are in row 62. The heat exchange tubes in row 62 are spaced two inches apart and three quarters of an inch from the sidewalls 18 and 20.

In the preferred embodiment, the rows of tubes 56,58,60 and 62 are spaced two inches apart and one inch from the portion 40 of the cold air portion 38 and the hot air partition 22. The portion of the cold air chamber 44 between the portion 40 of the cold air partition 38 and the front wall 22 of the outer enclosure 12 is one inch while the blower 26 is two inches and the hot air chamber 30 is two inches in a similar direction for an overall length of the furnace structure of the invention of 18 inches.

Similarly, the heat exchange tubes 56,58,60 and 62 where they connect to the hot air partition 22 are spaced apart two inches and are spaced one inch from the portion 42 of the cold air partition 38 and the bottom 16 of the outer enclosure 12 of the furnace structure 10, and the cold air chamber 44 has a dimension of one inch between the portion 42 of the cold air partition 38 and the top 14 of the outer furnace enclosure 12. Thus, the overall height of the furnace structure 10 from the bottom 16 to the top 14 is 14 inches.

As shown, baffles 68,70,72 and 74 depend alternately from the bottom 16 of the outer furnace enclosure 12 and from the portion 42 of the cold air partition 38 and extend completely between the sidewalls 18 and 20 of the furnace structure 10. The baffles serve to circulate hot combustion gases from the burner 54 over the heat exchange tubes in the rows 56,58,60 and 62 for most efficient heat transfer between the hot combustion gases in the combustion gas chamber 48 and the air in the heat exchange tubes. As shown, the baffles come within three inches of the bottom 16 of the furnace structure 10 and the cold air partition portion 42 to which they are not connected.

In certain embodiments of the invention, it is contemplated that the heat exchange tubes in the rows 56, 58,60 and 62 will themselves act as baffles to provide adequate circulation of the combustion gases therearound due to their placement, size and configuration.

Thus, in overall operation of the furnace structure 10, the burner 54 is lit to provide hot combustion gases in the combustion gas chamber 48 which is forced to travel in circuitious path through the combustion gas chamber 48 by the baffles 68,70,72 and 74 or the tubes in the rows 56,58,60 and 62. Ultimately, the combustion gases greatly cooled pass out of the exhaust tubes 50, manifold tube 51 and combustion gas flue 53.

The traverse of the combustion gases through the combustion gas chamber 48 exhaust tubes 50, manifold 53 and combustion gas flue 53 may be regulated to some extent by the draft diverter 52 and if desired, a draft fan.

Cool air taken in by the blower 26 is past into the cool air chamber 44 under pressure from the blower 26 and is forced through the heat transfer tubes in the rows 56,58,60, and 62 where the cool air is heated. The heated air is then passed into the hot air chamber 30 and subsequently into the plenum 32 from which it may be distributed, as desired.

The furnace structure of the invention is particularly compact and efficient and is therefore well suited for use in small homes, motor homes, summer cottages and the like.

Further, the furnace structure of the invention is particularly simple in construction and therefore easy to manufacture and low in cost.

While one embodiment of the present invention has been considered in detail, it will be understood that other embodiments and modifications thereof are contemplated by the inventor. Thus, while the preferred embodiment of the invention has the particular dimensions indicated above, it will be understood that other sizes of the furnace structure of the invention are contemplated which are proportionally similar. It is the intention to include all embodiments and modifications of the invention as are defined by the appended claims within the scope of the invention.

I claim:

1. Furnace structure comprising a generally rectangular outer enclosure including a top, bottom, two sides, a front end and a back end, a blower at the front end of the outer enclosure, a cool air chamber adjacent the front end and top of the outer enclosure in communication with said blower for receiving cool air from the blower, a hot air chamber at the back end of the outer enclosure, a combustion gas chamber between the cool air chamber at the front end of the outer enclosure and the hot air chamber at the back end of the outer enclosure, a burner positioned in the combustion gas chamber adjacent the bottom and front thereof, four rows of heat exchange tubes extending from the cool air chamber at the top of the outer enclosure to the hot air chamber through the combustion gas chamber spaced apart from the front to the back of the combustion gas chamber wherein the first row of heat exchange tubes are two inch diameter tubes, the second row of heat exchange tubes are one and a half inch diameter tubes, the third row of heat exchange tubes are one inch diameter tubes and the fourth row of heat exchange tubes are one half inch diameter tubes whereby fuel and air burned in the burner creates combustion gas in the combustion gas chamber which moves around the heat exchange tubes in the combustion gas chamber and heats air therein passing between the cool air chamber and hot air chamber.

2. Furnace structure comprising a generally rectangular outer enclosure including a top, a bottom, two sides, a front end and a back end, a hot air partition in spaced relation to the back end of the outer enclosure defining a hot air chamber, an L-shaped cool air partition extending in spaced relation parallel to the front end of the outer enclosure toward the top thereof and then parallel to the top of the furnace structure to engage the hot air partition defining a cool air chamber at the front end and top of the outer enclosure and defining a combustion gas chamber between the cool air chamber and the hot air chamber, a blower at the front end of the furnace structure in communication with cool air chamber for blowing cool air into the cool air chamber, a burner in the combustion gas chamber adjacent the bottom of the furnace structure and the portion of the cool air partition extending parallel to the front end of the outer enclosure in which fuel and air is burned to create hot combustion gases in the combustion chamber and four L-shaped rows of heat exchange tubes extending from the portion of the cool air partition which is parallel to the top of the outer enclosure downwardly toward the bottom of the outer enclosure and then through the hot air partition through which air from the cool air chamber is passed into the hot air chamber through the combustion gas chamber, the first row of heat exchange tubes closest to the front and bottom of the outer enclosure being two inch diameter tubes the second row of heat exchange tubes being next closest to the front and bottom of the outer enclosure being one and a half inch tubes, the next row of heat exchange tubes being one inch tubes and the last row of heat exchange tubes closest to the top and back end of the outer enclosure being one inch tubes, and all of the heat exchange tubes being spaced two inches from each other.

3. Structure as set forth in claim 1, wherein the heat exchange tubes extend from the cool air chamber in a right angle downwardly from the top of the combustion gas chamber and then toward the back end of the combustion gas chamber into the hot air chamber.

4. Structure as set forth in claim 1, wherein the tubes are spaced two inches from each other.

5. Structure as set forth in claim 1, wherein the outer enclosure of the furnace structure is approximately eighteen inches long, fourteen inches high and twelve inches wide.

6. Structure as set forth in claim 1, and further including baffles within the combustion gas chamber directing the combustion gases through the combustion gas chamber to flow over the heat exchange tubes.

7. Structure as set forth in claim 1 and further including a combustion gas exhaust duct extending from the combustion gas chamber through the hot air chamber to outside of the outer enclosure and a draft diverter in the combustion gas exhaust duct outside of the outer enclosure.

8. Furnace structure as set forth in claim 2, and further including baffles extending alternately from the bottom of the combustion gas chamber and from the top of the combustion gas chamber completely across the combustion gas chamber between the sides of the outer enclosure for directing combustion gases around the heat exchange tubes.

* * * * *